US005372475A

United States Patent [19]

Kato et al.

[11] Patent Number: 5,372,475

[45] Date of Patent: Dec. 13, 1994

[54] FUEL PUMP

[75] Inventors: Takahiko Kato, Kariya; Motoya Ito, Anjo, both of Japan

[73] Assignee: Nippondenso Co., Ltd., Kariya, Japan

[21] Appl. No.: 42,267

[22] Filed: Apr. 2, 1993

Related U.S. Application Data

[63] Continuation-in-part of Ser. No. 739,102, Aug. 1, 1991, abandoned.

[30] Foreign Application Priority Data

| | | | |
|---|---|---|---|
| Aug. 10, 1990 | [JP] | Japan | 2-212921 |
| Jul. 15, 1991 | [JP] | Japan | 3-173991 |
| Apr. 3, 1992 | [JP] | Japan | 4-082465 |
| Feb. 24, 1993 | [JP] | Japan | 5-035405 |

[51] Int. Cl.[5] ..... F04D 17/06

[52] U.S. Cl. ..... 415/55.1

[58] Field of Search ..... 415/55.1, 55.2, 55.3, 415/55.4, 55.5, 200

[56] References Cited

U.S. PATENT DOCUMENTS

| | | | |
|---|---|---|---|
| 2,283,844 | 5/1942 | Brady, Jr. | 415/55.1 |
| 4,006,998 | 2/1977 | Schonwald | 415/55.1 |
| 4,141,674 | 2/1979 | Schoenwald . | |
| 4,493,620 | 1/1985 | Takei et al. . | |
| 4,556,363 | 12/1985 | Watanabe et al. . | |
| 4,784,587 | 11/1988 | Takei et al. . | |
| 4,806,073 | 2/1989 | Schoenwald . | |
| 4,907,945 | 3/1990 | Schoenwald . | |
| 4,943,208 | 7/1990 | Schoenwald . | |
| 4,992,022 | 2/1991 | Aust et al. . | |
| 5,024,578 | 6/1991 | Vansadia | 415/55.1 |

FOREIGN PATENT DOCUMENTS

| | | | |
|---|---|---|---|
| 46-26443 | 7/1971 | Japan . | |
| 47-17941 | 5/1972 | Japan . | |
| 56-32095 | 4/1981 | Japan . | |
| 81191 | 5/1982 | Japan | 415/55.1 |
| 97097 | 6/1982 | Japan | 415/55.1 |
| 57-157094 | 9/1982 | Japan . | |
| 58-222996 | 12/1983 | Japan . | |
| 59-141795 | 8/1984 | Japan . | |
| 60-173389 | 9/1985 | Japan . | |
| 61-104190 | 5/1986 | Japan . | |
| 61-210288 | 9/1986 | Japan . | |
| 150098 | 7/1987 | Japan | 415/55.1 |
| 63-63756 | 12/1988 | Japan . | |
| 32720 | 1/1991 | Japan . | |
| 724800 | 3/1980 | U.S.S.R. | 415/55.1 |

*Primary Examiner*—John T. Kwon

*Attorney, Agent, or Firm*—Cushman, Darby & Cushman

[57] ABSTRACT

A Westco type fuel pump includes an impeller (32) which has a plurality of vane grooves (322) and a plurality of vane plates (323) provided alternately along its outer periphery. Each vane groove (322) is constituted by groove portions (*322a, 322b*) formed in both sides of the impeller (32), respectively, with a partition wall (321) provided between the groove portions (*322a, 322b*). The partition wall has an outer peripheral surface (3210) located radially inside an outer peripheral surface (3230) of each vane plate (323) and has a predetermined thickness in an axial direction of the impeller. As the impeller (32) rotates, two vortex flows of fuel are generated along bottom surfaces (3221, 3222) of the groove portions (*322a, 322b*) and then smoothly merge together at a position outside the outer peripheral surface (3210) of the partition wall, thereby reducing a flow dead zone (96) in a pump flow passage (33). When the impeller (32) is molded by using molds, deformation of the molded impeller is prevented due to the thickness of the outer peripheral surface (3210). Of the surfaces of the impeller (32), therefore, the surfaces of each vane groove remain as they are after the molding, while both sides of the impeller (32) and the outer peripheral surfaces (3230) of the vane plates (323) are ground. Thus, the impeller (32) able to surely achieve a high level of pump performance can be easily provided by resin molding.

36 Claims, 13 Drawing Sheets

FUEL PUMP

CROSS-REFERENCES TO RELATED APPLICATIONS

This is a continuation-in-part application of Kato Ser. No. 07/739,102, filed on Aug. 1, 1991 which is now abandoned.

BACKGROUND OF THE INVENTION

1. Field of the Invention

The present invention relates to a fuel pump for supplying fuel to an internal combustion engine or the like. This pump is used, for example, to supply fuel under pressure to a fuel injection system in an automobile or the like.

2. Description of Related Art

An automobile or the like having an engine equipped with an electronic fuel injection system employs a motor-operated fuel injection pump as one part of a device for injecting fuel into the engine. The fuel pump is submerged in a liquid fuel contained in a fuel tank and is designed to deliver fuel under high pressure to an injector in accordance with a command from an electronic controller.

One known type of such a fuel pump is generally called a regenerative pump or a Westco type pump. The efficiency, for example, of a Westco type fuel pump is highly dependent on the cross section of a flow passage section and the configuration of vanes of an impeller.

Japanese Patent Publication No. 63-63756, Japanese Utility Model Publication No. 3-2720, and Japanese Patent Laid-Open No. 60-47894, for example, disclose Westco type fuel pumps in which a desired level of performance is achieved by setting dimensions, such as the flow passage representative size Rm, to particular values.

A conventional Westco type fuel pump will be described below with reference to FIGS. 21 and 22. An impeller 9 of the conventional Westco type fuel pump has a disk-like outer configuration. A plurality of vanes 93 and a plurality of vane grooves 92 are provided alternately at equal intervals along the edge contacting one broad surface of the disk and its outer peripheral surface and also the edge contacting the other broad surface of the disk and the outer peripheral surface. These vanes and vane grooves are positioned on both sides of the impeller 9 with a partition wall 91 therebetween. An outer peripheral surface 910 of the partition wall 91 has a diameter equal to that of an outer peripheral surface 930 of the vane 93. A pump flow passage 95 is defined between an outer periphery of the impeller 9 and an inner surface of a pump casing 90. When the impeller 9 rotates, the outer periphery of the impeller 9 passes through the pump flow passage 95 at a high speed. Therefore, centrifugal forces on liquid in the vane grooves 92 form two vortexes 941, 942 in the pump flow passage 95. With the rotation of the impeller 9, the liquid fuel in the pump flow passage 95 is delivered in a circumferential direction while forming the two vortexes 941, 942 and is pressurized.

With the conventional Westco type fuel pump, however, a dead zone 96 is produced between the two vortexes 941, 942 as shown in FIG. 22. In the dead zone 96, the liquid fuel does not have a sufficient flow speed, thereby causing a counter flow. This raises the problem that the counter flow prevents fuel from being delivered under high pressure.

To eliminate the counter flow, it could be contemplated to provide a projection radially extending from the casing side or the impeller side in such a manner as to fill the dead zone 96. However, providing such a projection to fill the dead zone 96 gives rise to a fear that the pressure of the fuel might be uneven between opposite lateral sides of the impeller, because the fuel cannot move between the opposite lateral sides.

Westco type pumps are also used for applications other than fuel pumps. Japanese Patent Laid-Open No. 61-210288, for example, discloses a Westco type water pump. The technique disclosed in this document is intended to suppress the counter flow produced in the pump flow passage due to the presence of the dead zone. This document proposes that the distal end of the impeller's partition wall should be pointed. The disclosed prior art also proposes that the height of the impeller's partition wall should be lower than that of its vanes to position the distal end of the partition wall inside the vanes.

A Westco type pump with the height of the impeller's partition wall lower than that of its vanes to position the distal end of the partition wall inside the vanes, is also disclosed in Japanese Patent Laid-Open No. 56-32095 relating to an air pump.

However, the water pump disclosed in Japanese Patent Laid-Open No. 61-210288 or the air pump disclosed in Japanese Patent Laid-Open No. 56-32095 is greatly different from a fuel pump with regard to delivery capacity under pressure, impeller diameter and other factors. Therefore, if the disclosed techniques relating to water or air pumps are directly applied to fuel pumps, it would be difficult to achieve desired pump performance and operating effect.

A typical water pump, for example, requires a flow rate of 100 to 10,000 l/h and a pressure of 5 to 10 $kgf/cm^2$. On the contrary, a typical fuel pump for automobile requires a flow rate of 50 to 200 l/h and a pressure of 2 to 5 $kgf/cm^2$. Thus, parameter ranges required for practical operation of the pumps are different from each other to a large extent. Further, an impeller of a water pump is typically about 100 mm in diameter, while an impeller conventionally used in a fuel pump for automobiles is about 50 mm or 30 mm in diameter. The impeller size for a fuel pump is limited by its location in an automobile fuel tank.

In addition, an air pump is greatly different from a fuel pump not only in rated values of capacity, efficiency, impeller diameter, etc., but also in such characteristics as compressibility and viscosity of a target substance since a fluid to be pressurized by the air pump is gas. Thus, the air pump disclosed in Japanese Patent Laid-Open No. 56-32095 has a short radial distance between the vane distal ends of the impeller and the wall surface of the flow passage.

Furthermore, because the impeller diameter is large in water and air pumps, impellers are generally manufactured using metal materials. The metal impeller can be machined to cut the vane grooves for making the distal end of the partition wall pointed. On the contrary, because of its small diameter, the impeller of a fuel pump is generally molded by, for example, injection molding, using resin materials. This means that it is difficult to make the distal end of the partition wall pointed in the fuel pump, since deformations or cracks are often formed when a molding is released from molds. Particularly, a fuel pump having a smaller impeller diameter has the problem that a slight deformation of the impeller configuration affects the fuel flow passing through the flow passage and lowers pump efficiency. Consequently, there is a difficulty in achieving desired pump performance by directly applying the configuration of the conventional water or air pump to a fuel pump.

SUMMARY OF THE INVENTION

In view of the above-mentioned problems encountered in the prior art, an object of the present invention is especially to improve performance of a fuel pump.

To this end, the fuel pump of the present invention includes a disk-like impeller which has vane grooves and vane plates formed alternately along an outer periphery of the impeller. The vane grooves are respectively open to both sides of the impeller and are parted by a partition wall in an axial direction of the impeller to define the vane plates. A casing rotatably accommodates the impeller and defines a pump flow passage along the outer periphery of the impeller and has an intake port and a delivery port both communicating with the pump flow passage. A motor rotates the impeller.

Each vane groove of the impeller includes a first groove portion on one side of the impeller, a second groove portion on the other side of the impeller, and a communicating groove positioned radially outside the first and second groove portions for allowing the first and second groove portions to communicate with each other in the axial direction. The first and second groove portions and the communicating groove are defined between side walls of adjacent vane plates. Each partition wall is positioned between the first and second groove portions to provide bottom surfaces of the first and second groove portions, the bottom surfaces being formed to gradually approach each other while extending in a radial direction from an inner side toward an outer side of the impeller, and being terminated at a position inside an outer peripheral end of each vane plate to define the communicating groove. At their termination, the bottom surfaces are separated from each other by a predetermined distance.

With the fuel pump arrangement of the invention summarized above, the impeller has the vane plates and the partition walls which define the respective vane grooves on both sides of the impeller. The partition walls according to the invention are each terminated at a position inside the outer peripheral end of each vane plate such that the opposite bottom surfaces of each vane groove are separated by the predetermined distance at their outermost ends.

Accordingly, the distal ends of the partition walls are not positioned to directly face the outermost periphery of the impeller and, therefore, vortex flows of fuel generated along the bottom surfaces of each vane groove extend over the entire flow passage and thus reduce the flow dead zone for increased pump efficiency.

Experiments made by the present inventors have proved that by terminating the bottom surfaces of each vane groove with the predetermined distance between their outermost ends, there can be obtained higher pump performance than such a configuration of the partition wall that the bottom surfaces are terminated in contact with each other to provide a pointed end.

It is considered that the higher pump performance results because an area is formed outside the distal end of each partition wall into which vortex fuel will not directly enter. The fuel in that area allows the vortex fuel flows to be smoothly merged together outside the distal end of the partition wall.

Further, by terminating the bottom surfaces of each vane groove separated by the predetermined distance at their outermost ends, deformation of the distal end of the partition wall at its outermost periphery, which would otherwise occur upon release of a molding from molds, can be prevented, making it possible to obtain the impeller of a desired shape and achieve desired pump performance with certainty. Thus, the impeller can be manufactured by molds, with the results of improved production efficiency.

DETAILED DESCRIPTION OF THE PREFERRED EMBODIMENTS

Figure 1:
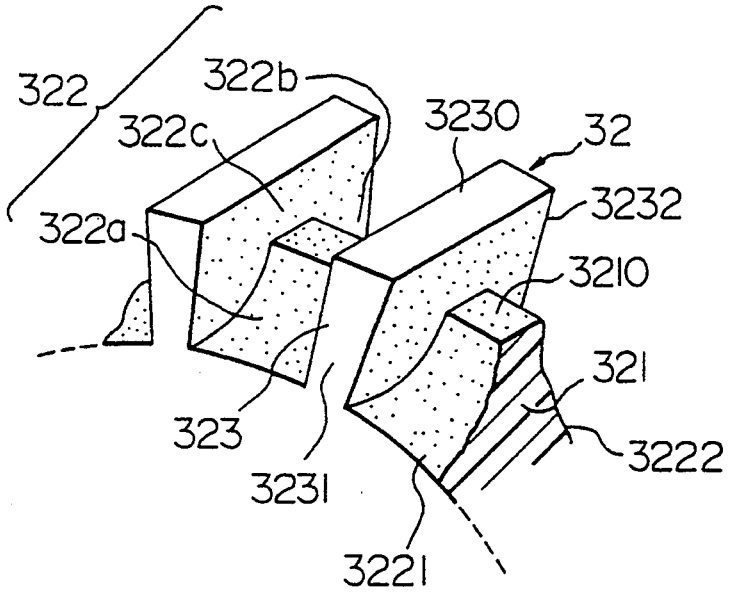
FIG. 1 is a fragmentary perspective view showing an impeller of a fuel pump according to a first embodiment of the present invention.

A fuel pump according to the first embodiment of the invention will be described below with reference to FIGS. 1 to 6. The fuel pump is used with a fuel supply system of an internal combustion engine for a motor vehicle.

The overall structure of the fuel pump will first be explained by referring to FIGS. 4 and 5.

The fuel pump comprises a motor section 2 and a pump section 3.

The motor section 2 comprises a permanent magnet 21 disposed on an inner wall surface of a substantially cylindrical housing 1, and an armature 22 rotatably disposed inside the permanent magnet 21 in concentric relation to the magnet 21.

The pump section 3 comprises casings 311, 312 fixed to one end of the housing 1, and a disk-like impeller 32 rotating in a disk-shaped space defined between the casings 311 and 312 in concentric relation to the space. The impeller 32 is attached to a shaft 220 of the armature 22 penetrating through the casing 311.

Between an outer periphery of the impeller 32 and the casings 311, 312, there is formed a pump flow passage (hereinafter referred to simply as a flow passage) 33. The flow passage 33 as an intake port 41 at one end thereof and a delivery port 43 at the other end, and is formed into a C-shape along the outer periphery of the impeller 32. Fuel is introduced to the flow passage 33 through the fuel intake port 41 which is formed in the casing 312.

Figure 4:
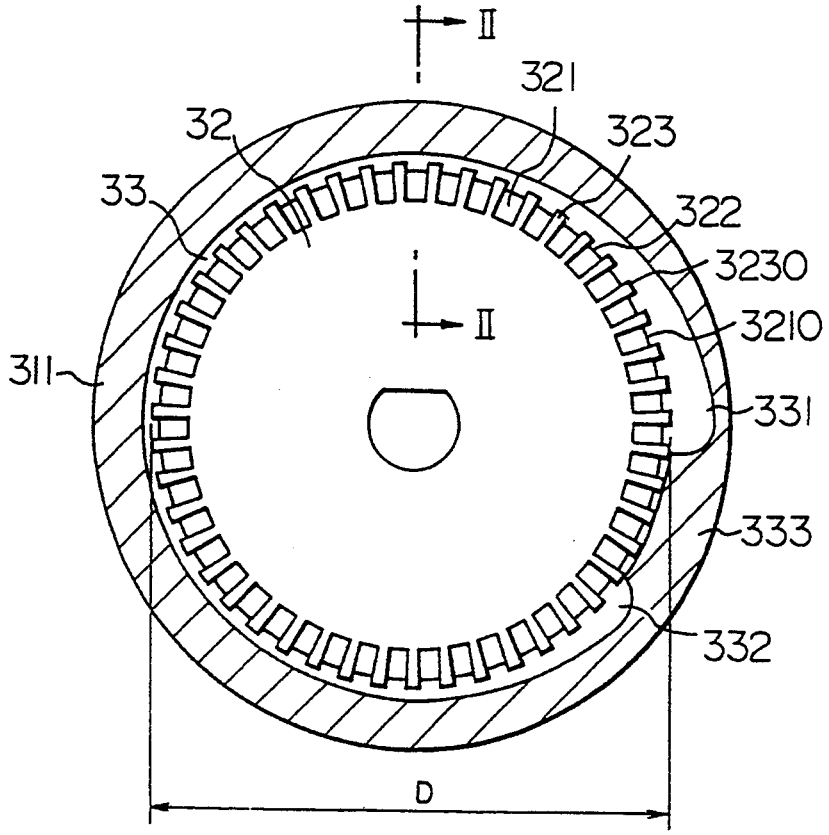
FIG. 4 is a front view of the impeller of the first embodiment.
Figure 5:
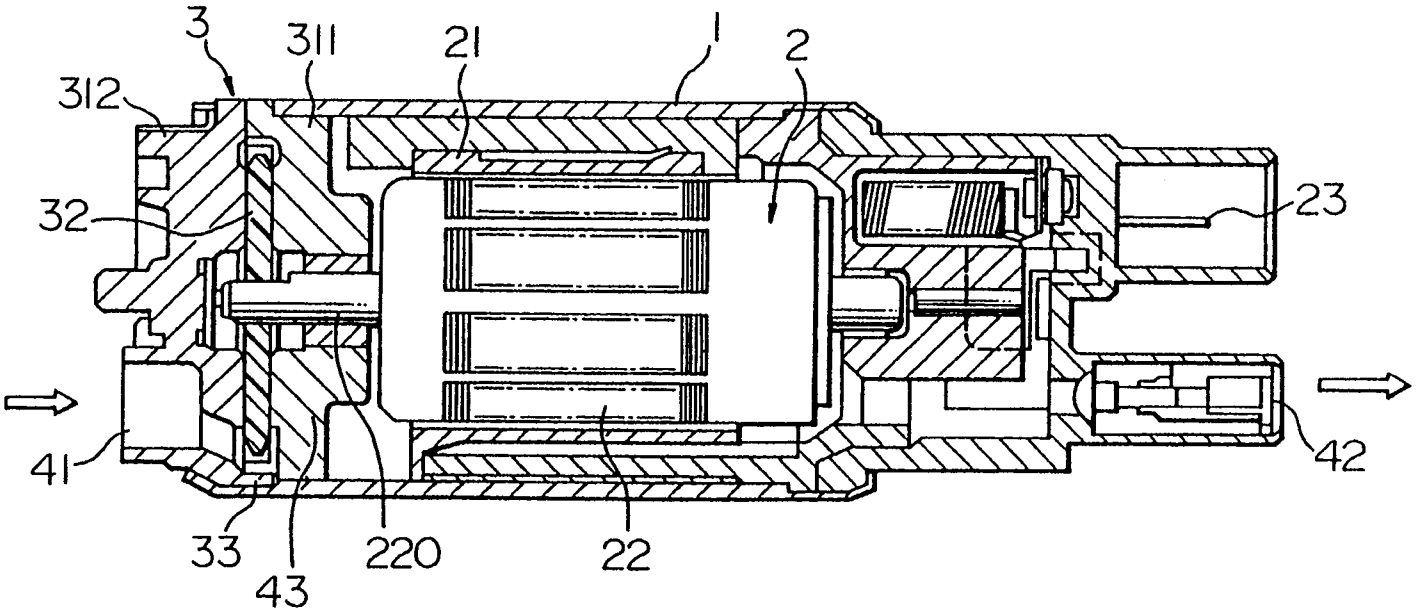
FIG. 5 is a sectional view of the fuel pump of the first embodiment.

The flow passage 33 is formed into the C-shape along the outer periphery of the impeller 32, as mentioned above, and has an intake portion 331 and a delivery portion 332 formed in respective predetermined positions with a parting wall 333 therebetween (see FIG. 4). These flow passage intake and delivery portions 331, 332 are larger in radial size than other portions of the flow passage 33, and the flow passage intake portion 331 is larger in radial size than the flow passage delivery portion 332. The flow passage intake portion 331 communicates with the fuel intake port 41, while the flow passage delivery portion 332 communicates with the interior of the housing 1 via the fuel delivery port 43 which is bored to penetrate through the casing 311.

The fuel in the housing 1 is delivered from a fuel delivery portion 42 provided at an opposite end of the housing 1. A connector is provided beside the fuel delivery portion 42 and has a terminal 23 through which electric power is supplied to the motor section 2. The terminal 23 is connected to a brush (not shown) via noise preventing elements such as a coil and a capacitor.

The configuration of the impeller 32 will now be described in detail with reference to FIGS. 1 to 4.

The impeller 32 is rotatably accommodated between the casings 311 and 312 which are fixed in the housing 1 by press-fitting.

A plurality of vane plates 323 are formed around the outer periphery of the impeller 32 with predetermined intervals, and a vane groove 322 is formed between adjacent pairs of vane plates 323.

Each vane groove 322 includes groove portions 322*a*, 322*b* respectively positioned on opposite lateral sides of the impeller 32 at its outer periphery, and another groove portion (hereinafter referred to sometimes as a communicating groove) 322*c* positioned at the outermost periphery of the impeller 32 for providing communication between the groove portions 322*a*, 322*b* in an axial direction. Vane groove portions 322*a*, 322*b*, 322*c* collectively define the vane groove 322 which is substantially C-shaped in cross-section as it wraps around partition wall 321 and extends from one lateral side to the other lateral side of the impeller 32 while passing the outermost periphery thereof.

A vane plate 323 is formed between each pair of adjacent vane grooves 322 in a circumferential direction. Each vane plate 323 has a radial vane shape which extends outwardly perpendicular to the circumferential direction, and is adjacent to opposite ends of vane grooves 322 in the circumferential direction to form side walls of the vane grooves 322.

Each pair of vane groove portions 322*a*, 322*b*, positioned on opposite sides of the impeller 32, are separated from each other by a partition wall 321 which tapers toward the outermost periphery of the impeller 32. The partition wall 321 has a small flat portion at its distal end and two opposite slopes which define a bottom surface 3221 of the groove portions 322*a* and a bottom surface 3222 of the groove portion 322*b*. These bottom surfaces 3221, 3222 are each formed as a curved surface having the radius of curvature R (see FIG. 2). The axial distance between the bottom surface 3221 and the bottom surface 3222 is gradually reduced toward the outermost periphery of the impeller 32 to become minimum at the outermost end of the partition wall 321. This minimum distance is also determined as a distance between the outermost ends of the bottom surfaces 3221 and 3222. Further, an outer peripheral surface 3210 of the partition wall 321 defines a bottom surface of the vane groove portion 322*c*.

With the above structure, the fuel is urged in a rotating direction of the impeller 32 by not only side walls of the vane groove portions 322*a*, 322*b*, but also side walls of the vane groove portions (communicating grooves) 322*c*.

Figure 2:
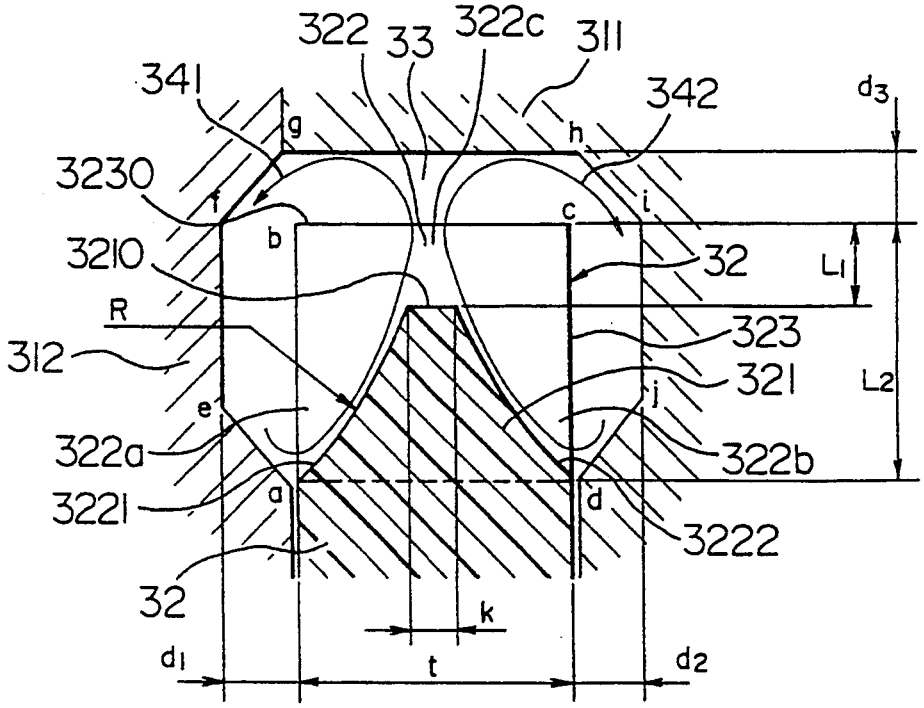
FIG. 2 is an enlarged sectional view, taken along the II—II line in FIG. 4, showing principal parts of the fuel pump of the first embodiment.

The partition wall 321 of the impeller 32 is arranged, as shown in FIGS. 1 and 2, such that the outer peripheral surface 3210 is located radially inside outer peripheral surfaces 3230 of the vane plates 323 which define the outermost peripheral surface of the impeller 32. In this embodiment, the radial length L1 of each vane groove portion 322*c*, i.e., the radial distance between the outer peripheral surface 3210 of the partition wall 321 and the outer peripheral surface 3230 of the vane plate 323, is set to 40% of the length L2 of each vane plate 323 (see FIG. 2).

Figure 3:
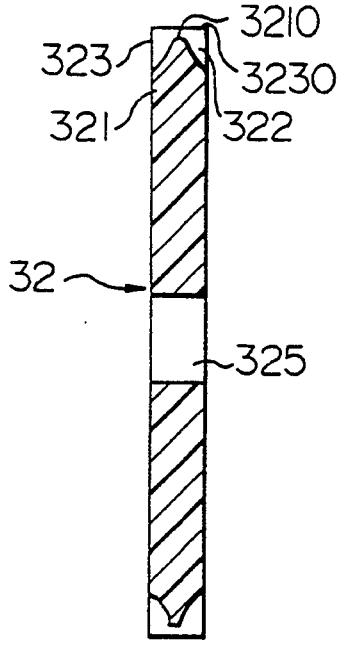
FIG. 3 is a sectional view of the impeller of the first embodiment.

As shown in FIGS. 3 and 4, the vane plates 323 and the vane grooves 322 are disposed alternately with predetermined intervals around the outer periphery of the impeller 32 in the circumferential direction. At the center of the impeller 32, there is bored a shaft hole 325 for allowing the shaft 220 to be fitted into and penetrate through the hole 325.

Various dimensions (all in millimeters) of sides of the impeller in the embodiment described above are as shown in Table 1 below.

TABLE 1

| D | t | d1 d2 | d3 | R | L1 | L2 | Rm | K |
|---|---|---|---|---|---|---|---|---|
| 30 | 2.4 | 0.7 | 0.7 | 4 | 1.0 | 2.4 | 0.7 | 0.3 |

D: diameter t: thickness d1,d2: axial gap d3: radial gap R: curvature of recessed surface L1: entire radial length of communicating passage L3: entire radial length of vane Rm: flow passage representative size k: end face length of partition wall In Table 1, the diameter D indicates a diameter of the impeller including the vanes at the outer periphery; the thickness t indicates an axial thickness of the impeller; the axial gap d1=d2 indicates a distance between axial ends of each vane plate 323 and inner lateral surfaces of the casings 311, 312; and the radial gap d3 indicates a distance between a radial end of each vane plate 323 and an inner peripheral surface of the casing 311. The curvature of recessed surfaces R indicates a radius of curvature of both the sloped bottom surfaces of each partition wall 321 of the impeller; the entire radial length of communicating passage L1 indicates a radial length of the communicating passage or groove 322C from the outer peripheral surface 3210 of each partition wall 321 to the outer peripheral surface 3230 of each vane plate 323; and the entire radial length of vane L2 indicates a radial length of each vane plate 323 from its inner periphery to its outer peripheral surface 3230, including the communicating passage. The flow passage representative size Rm is determined by S/l on the assumption that the axial sectional area of the flow passage defined by segments of a–b–c–d–j–i–h–g–f–e–a in FIG. 2 is S and the peripheral length of a section along peripheral edges of the impeller defined by segments of a–b–c–d in FIG. 2. The end face length of partition wall k indicates an axial length of the outer peripheral surface 3210 of each partition wall 321.

Figure 6:
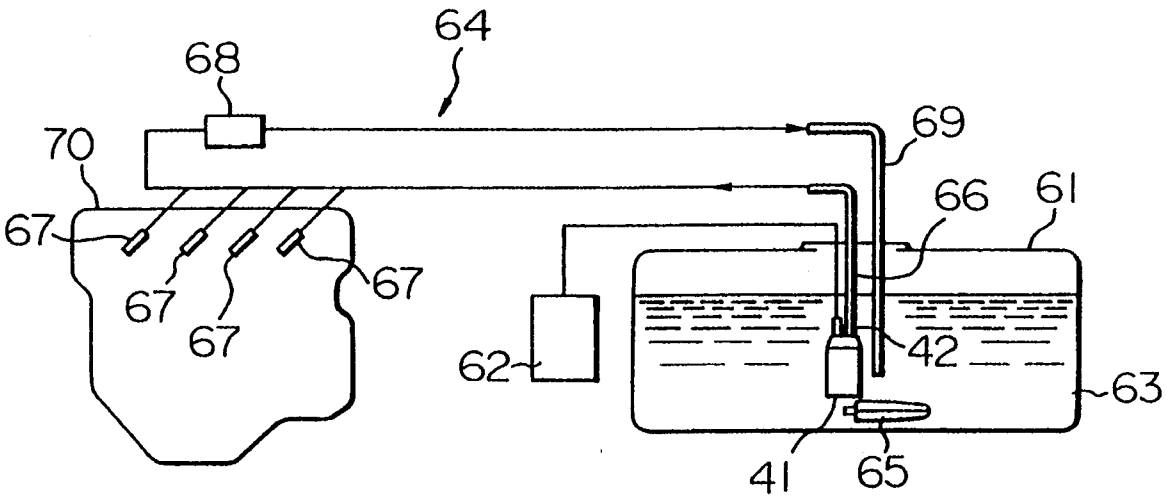
FIG. 6 is a schematic view showing a fuel injection system using the fuel pump of the first embodiment.

As shown in FIG. 6, the fuel pump of this embodiment is installed in a fuel tank 61 which is mounted on a motor vehicle and is connected to an on board battery 62. The fuel pump supplies fuel 63 in the fuel tank 61 to a fuel injection system 64. A fuel filter 65 is connected to the fuel intake port 41 of the fuel pump, and a pipe 66 is connected to the fuel delivery port 42. The pipe 66 supplies fuel to injectors 67 of the fuel injection system 64. The fuel pressure is adjusted by a regulator 68 to a predetermined value. The fuel discharged from the regulator 68 is returned to the fuel tank 61 via a return pipe 69. Each of the injectors 67 sprays fuel into an intake passage of an engine 70.

The fuel pump which is used with the fuel injection system of an internal combustion engine for a motor vehicle like this embodiment is operated such that its delivery rate is in the range of 50 to 200 l/h and a pressure is in the range of 2 to 5 kgf/cm$^2$. Taking into account environmental conditions under which the motor vehicle is used, the fuel pump is designed to operate in the temperature range of about −30° to 80° C. without any troubles.

For the fuel pump used at the above delivery rate and delivery pressure, preferably, the impeller diameter is set to 20–65 mm and the flow passage representative size Rm is set to 0.4–2.0 mm. More preferably, the flow passage representative size Rm is set to 0.6–1.6 mm. Specific dimensions of such a fuel pump are disclosed in Japanese Patent Publication No. 63-63756 or U.S. Pat. No. 4,493,620.

Figure 7:
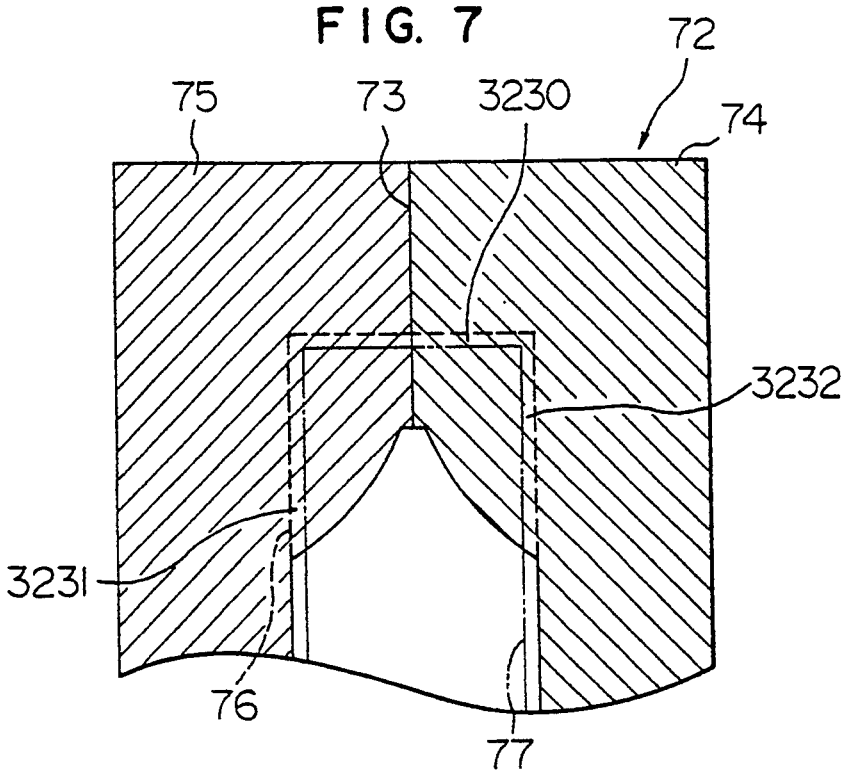
FIG. 7 is a fragmentary sectional view of a mold used for molding the impeller of the first embodiment.

A description will now be made of a process of manufacturing the impeller of this embodiment. FIG. 7 is a fragmentary sectional view of a mold used for molding the impeller 32. FIG. 7 shows a section of the part corresponding to the vane groove 322.

A mold 72 comprises two portions 74, 75 divided at a mold parting plane 73 which corresponds to the axial center of the impeller 32. The inner cavity configuration of the mold 72 is formed in accordance with the shape of the impeller 32, though the cavity is slightly larger than the impeller 32 in directions of its diameter and thickness. In FIG. 7, a broken line 76 indicates the inner cavity configuration of the mold 72, and a two-dot-chain line 77 indicates the final shape of the impeller 32. As will be seen from FIG. 7, the inner cavity configuration of the mold 72 at a position corresponding to the vane groove 322 of the impeller 32 is similar to the shape of the impeller 32.

To manufacture the impeller 32, a thermosetting resin is first poured into the mold 72 for roughly molding the outer configuration of the impeller. The molded impeller is somewhat larger in diameter and thickness than the finished impeller 32. The molded impeller has the same configuration in its portion corresponding to each vane groove 322 as the finished impeller 32. The material of the impeller 32 is a phenol resin mixed with glass fibers as reinforcement. Use of such a thermosetting resin lessens volume changes due to temperature changes and enables the pump to operate while maintaining a high level of performance over a wide range from low to high temperatures.

Then, both lateral sides and an outer peripheral surface of the impeller molded by using the mold 72 are grounded. Specifically, in this grinding step, both the lateral sides of the impeller, as well as the outer peripheral surface 3230 and both side surfaces 3231, 3232 of each vane plate 323 are grounded. After the grinding, the configuration of the impeller 32 as shown in FIGS. 1 to 4 is completed. Thus, among the surfaces of the impeller 32 shown in FIG. 1, those surfaces which are indicated by dot patterns are formed by only molding without being ground. Particularly, in this embodiment, the outer peripheral surface 3210 at the distal end of each partition wall 321 is not ground.

As described above, in this embodiment, the impeller 32 is molded by using the mold 72. Therefore, the many vane grooves 322 can be simply formed, making the impeller well adapted for mass production. If the distal end of the partition wall 321 is too thin, it may be deformed when the molds 74 and 75 are opened to release the molding, thus leading to a large influence upon the pump performance. On the contrary, in this embodiment, the outer peripheral surface 3210 of each partition wall 321 is formed into a flat shape to ensure a sufficient thickness even at the distal end of the partition wall 321. Therefore, when the molded impeller is released from and taken out of the molds 74 and 75, deformation of the partition wall 321 is prevented. Particularly, in the case of using a thermosetting resin as with this embodiment, there is a fear that the partition wall 321 may crack upon opening the molds because the thermosetting resin is generally brittle. However, by making the distal end of the partition wall 321 thick to increase the strength as in this embodiment, the thermosetting resin can be prevented from cracking at the distal end of the partition wall 321.

Operation and advantages of the fuel pump of the embodiment constructed as above will be described below.

When electric power is supplied to the motor section 2 from the battery 63 via the terminal 23, the armature 22 is rotated in the motor section 2. The rotation of the armature 22 is transmitted to the impeller 32 via the shaft 220 for rotating the impeller 32.

With the rotation of the impeller 32, the fuel in the fuel tank 61 is sucked into the flow passage 33 through the fuel intake port 41 and pressurized in the flow passage 33 by the vane plates 323 of the impeller 32. Then, the fuel reaches the fuel delivery port 42 and is delivered under pressure from the fuel delivery port 42 to the injectors 67.

Thus, when the impeller 32 is rotated in the casings 311, 312, the outer peripheral portion of the impeller 32 passes the flow passage 33 at a high speed. The liquid fuel in the flow passage 33 is moved in the circumferential direction while forming two vortexes 341, 342 due to centrifugal forces, thereby mainly increasing a dynamic pressure of the fuel.

In this embodiment, the flow passage 33 is axially divided by only the partition walls 321 of the impeller 32. Since portions of each vane groove 322 which are located outside the outer peripheral surface 3210 of the partition wall 321 thoroughly communicate with each other in the axial direction via the vane groove portion 322*c*, the fuel can easily move between the opposite lateral sides of the impeller 32 so that the pressure of the fuel is prevented from being locally imbalanced between opposite lateral sides of the impeller. As a result, generation of a pressure axially urging the impeller 32 is suppressed to reduce a friction resistance and noises during the rotation of the impeller 32.

Further, since the outer axial surface of each vane plate 323, which urges the fuel in the circumferential direction is provided outside the outer peripheral surface 3210 of the partition wall 321, the fuel can be urged circumferentially by the effective outer axial surfaces of the vane plates 323, allowing a larger quantity of fuel to be moved in the rotating direction of the impeller 32. Additionally, the counter vortex which has been conventionally produced between the outer peripheral surface of the partition wall and the inner peripheral surface of the casing can be diminished to enhance a capability of raising the fuel pressure and provide a higher delivery pressure with the same electric power.

Furthermore, in this embodiment, the configuration of only the impeller 32 is changed, while the configurations of the casings and other components remain the same as those of fuel pumps which have been conventionally put into practice. Accordingly, pump performance of the conventional fuel pumps can be greatly improved just by updating facilities for manufacture of impellers, resulting in a large practical value.

In order to determine the dimensions of the fuel pump of this embodiment, several experimental pumps were fabricated and their efficiencies were tested. The results of the experiments will be described below for showing that the above-mentioned dimension values of this embodiment can provide good pump efficiency.

In the experiments, the pump input was calculated as the product of a load torque and a rotational speed, and the pump output was calculated as the product of a delivery pressure and a delivery rate. The delivery pressure was measured by using both a digital multimeter manufactured by Advantest Co. and a small-sized semiconductor pressure sensor manufactured by Toyoda Machine Works Ltd. The delivery flow rate was measured by using a digital flowmeter manufactured by Ono Measuring Instrument Ltd.

First, fuel pumps having different impellers and flow passage configurations as shown in Table 2 below were fabricated by way of trial and their efficiencies were measured. The pump efficiencies resulting from these experimental examples are plotted in FIG. 8.

TABLE 2

| No. | D | t | d1 d2 | d3 | R | L1 | L2 | Rm | k |
|---|---|---|---|---|---|---|---|---|---|
| 1 | 30 | 2.4 | 0.6 | 0.7 | 4 | 0 | 2.4 | 0.63 | 0.3 |
| 2 | 30 | 2.4 | 0.7 | 0.7 | 4 | 0 | 2.4 | 0.70 | 0.3 |
| 3 | 30 | 2.4 | 0.8 | 0.7 | 4 | 0 | 2.4 | 0.77 | 0.3 |
| 4 | 30 | 2.4 | 0.9 | 0.7 | 4 | 0 | 2.4 | 0.83 | 0.3 |
| 5 | 30 | 2.4 | 0.7 | 0.7 | 4 | 0.5 | 2.4 | 0.7 | 0.3 |
| 6 | 30 | 2.4 | 0.6 | 0.7 | 4 | 1.0 | 2.4 | 0.63 | 0.3 |
| 7 | 30 | 2.4 | 0.7 | 0.7 | 4 | 1.0 | 2.4 | 0.70 | 0.3 |
| 8 | 30 | 2.4 | 0.8 | 0.7 | 4 | 1.0 | 2.4 | 0.77 | 0.3 |
| 9 | 30 | 2.4 | 0.9 | 0.7 | 4 | 1.0 | 2.4 | 0.83 | 0.3 |
| 10 | 30 | 2.4 | 0.6 | 0.7 | 4 | 1.5 | 2.4 | 0.63 | 0.3 |
| 11 | 30 | 2.4 | 0.7 | 0.7 | 4 | 1.5 | 2.4 | 0.70 | 0.3 |
| 12 | 30 | 2.4 | 0.8 | 0.7 | 4 | 1.5 | 2.4 | 0.77 | 0.3 |
| 13 | 30 | 2.4 | 0.9 | 0.7 | 4 | 1.5 | 2.4 | 0.83 | 0.3 |

D: diameter t: thickness d1,d2: axial gap d3: radial gap R: curvature of recessed surface L1: entire radial length of communicating passage L3: entire radial length of vane Rm: flow passage representative size k: end face length of partition wall (all dimensions in millimeters)

In Table 2, the experimental Nos. 1 to 4 employ conventional impellers formed with no communicating passages or grooves.

Figure 8:
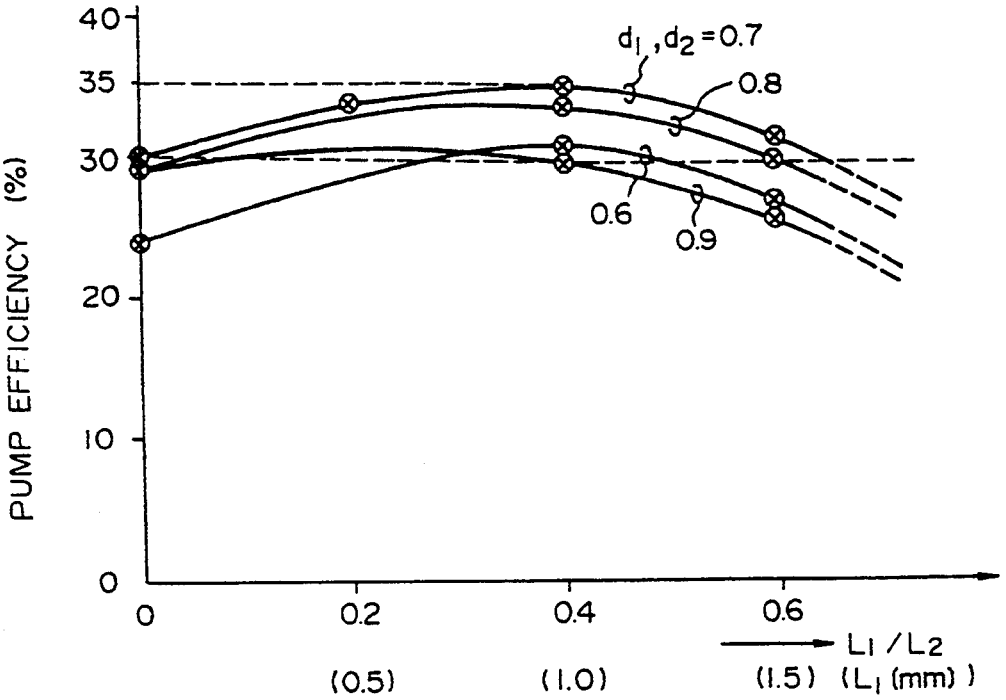
FIG. 8 is a graph showing pump efficiency of the fuel pump of the first embodiment when dimension parameters $d1=d2$ and L1 are changed.

From the graph of FIG. 8, indicating the pump efficiencies of the experimental examples in Table 2, the experimental example No. 7 provides the maximum efficiency which is about 35%.

Of the experimental examples representing the pumps which employ the conventional impellers, No. 2 provides the highest efficiency of about 30%. It is thus found that by setting the ratio of L1/L2 to about 0.4, any pump having communicating passages can provide higher efficiency than the conventional pumps no matter which value d1=d2 takes in the range of 0.6 to 0.9. It is also found that by setting d1=d2 in the range of about 0.7 to 0.8, any present pump can provide higher efficiency than the conventional pumps no matter which value the ratio of L1/L2 takes in the wide range of 0 to about 0.6.

In the characteristic curves plotted in FIG. 8, the efficiencies decline in almost similar manner when the ratio of L1/L2 becomes larger. Since the dimension L1 is changed in the experimental examples, it is believed that the sloped surfaces of each partition wall become too short to satisfactorily produce the vortexes 341, 342 when the ratio of L1/L2 takes a large value.

Figure 22:
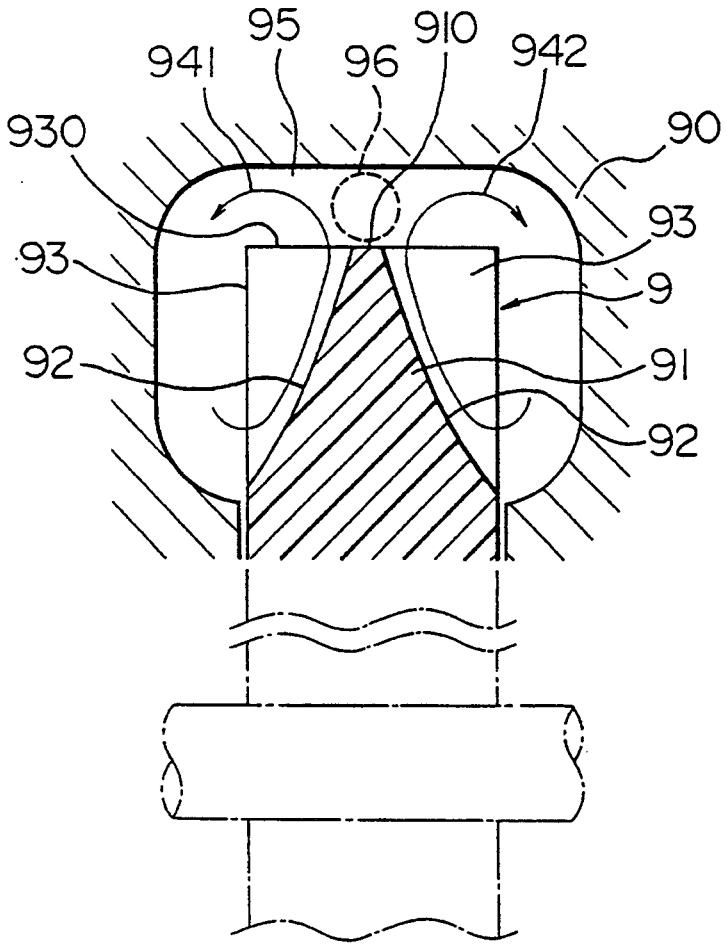
FIG. 22 (PRIOR ART)
FIG. 22 is an enlarged sectional view showing principal parts of the impeller of FIG. 21.

Also, in the characteristic curves of FIG. 8, the efficiencies decline in almost similar fashion when the ratio of L1/L2 becomes smaller. Since the radial distal end face of the partition wall 321 approaches the outer periphery of the flow passage, it is believed that the flow dead zone 96 (see FIG. 22) is generated and the counter flow passing the dead zone 96 reduces the pump efficiencies.

In addition, when the axial gap d1=d2 is set to 0.6 or 0.9, the pump efficiency drops to a large extent. This is believed to be the case since the small axial gap d1=d2 reduces the delivery rate and also disables generation of the satisfactory vortexes 341, 342.

On the other hand, it is believed that the large axial gap d1=d2 makes the flow passage too large and hence generates undesired vortexes which lower the pump efficiency.

Further, fuel pumps having different impellers and flow passage configurations as shown in Table 3 below were fabricated by way of trial and their efficiencies were measured. The pump efficiencies resulting from these experimental examples are plotted in FIG. 9.

TABLE 3

| No. | D | t | d1 d2 | d3 | R | L1 | L2 | Rm | k |
|---|---|---|---|---|---|---|---|---|---|
| 21 | 30 | 2.0 | 0.7 | 0.7 | 4 | 0 | 2.4 | 0.7 | 0.3 |
| 22 | 30 | 2.4 | 0.7 | 0.7 | 4 | 0 | 2.4 | 0.7 | 0.3 |
| 23 | 30 | 3.0 | 0.7 | 0.7 | 4 | 0 | 2.4 | 0.7 | 0.3 |
| 24 | 30 | 2.0 | 0.7 | 0.7 | 4 | 0.5 | 2.4 | 0.7 | 0.3 |
| 25 | 30 | 2.4 | 0.7 | 0.7 | 4 | 0.5 | 2.4 | 0.7 | 0.3 |
| 26 | 30 | 3.0 | 0.7 | 0.7 | 4 | 0.5 | 2.4 | 0.7 | 0.3 |
| 27 | 30 | 2.0 | 0.7 | 0.7 | 4 | 1.0 | 2.4 | 0.7 | 0.3 |
| 28 | 30 | 2.4 | 0.7 | 0.7 | 4 | 1.0 | 2.4 | 0.7 | 0.3 |
| 29 | 30 | 3.0 | 0.7 | 0.7 | 4 | 1.0 | 2.4 | 0.7 | 0.3 |
| 30 | 30 | 2.0 | 0.7 | 0.7 | 4 | 1.5 | 2.4 | 0.7 | 0.3 |
| 31 | 30 | 2.4 | 0.7 | 0.7 | 4 | 1.5 | 2.4 | 0.7 | 0.3 |
| 32 | 30 | 3.0 | 0.7 | 0.7 | 4 | 1.5 | 2.4 | 0.7 | 0.3 |

D: diameter t: thickness d1,d2: axial gap d3: radial gap R: curvature of recessed surface L1: entire radial length of communicating passage L3: entire radial length of vane Rm: flow passage representative size k: end face length of partition wall (all dimensions in millimeters)

In the experimental examples of Table 3, the entire axial length of the flow passage is changed depending on changes in the thickness t of the impeller.

In Table 3, the experimental examples No. 21 to 23 employ conventional impellers formed with no communicating passages or grooves.

Figure 9:
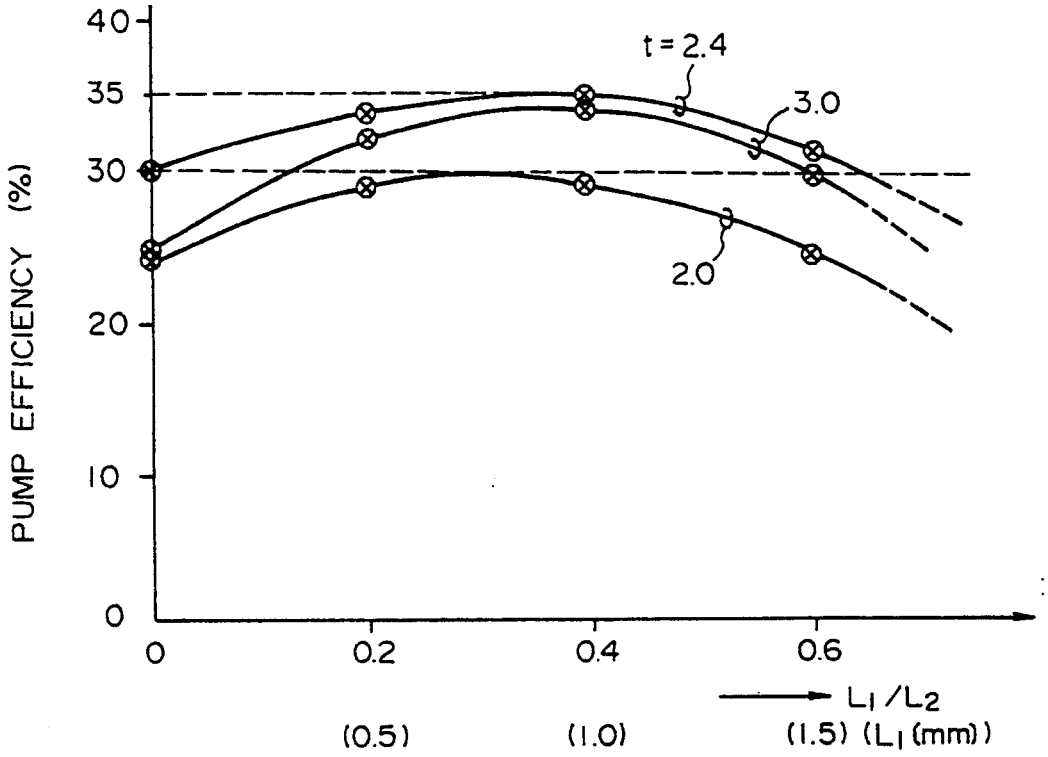
FIG. 9 is a graph showing pump efficiency of the fuel pump of the first embodiment when a dimension parameter t is changed.

From the graph of FIG. 9 indicating the pump efficiencies of the experimental examples in Table 3, it has proved that the experimental example No. 28 provides the maximum efficiency which is about 35%.

Of the experimental examples representing the pumps which employ the conventional impellers, No. 22 provides the highest efficiency of about 30%. It is thus found that by setting the ratio of L1/L2 to about 0.4, any pump having communicating passages can provide efficiency almost equal to or higher than the conventional pumps no matter which value the thickness t takes in the range of 2.0 to 3.0.

It is also found that by setting the thickness t in the range of about 2.4 to 3.0, any present pump can provide efficiency almost equal to or higher than the conventional pumps no matter which value the ratio of L1/L2 takes in the wide range of 0.1 to about 0.6.

In the characteristic curves plotted in FIG. 9, the efficiencies decline in almost similar fashion when the ratio of L1/L2 becomes larger. Since the dimension L1 is changed in the experimental examples, it is believed that the sloped surfaces of each partition wall, or the bottom of each vane groove, become too short to satisfactorily produce the vortexes 341, 342 when the ratio of L1/L2 takes a large value.

In addition, when the impeller thickness t is set to a small value, the pump efficiencies drop to a large extent. It is believed that the small thickness t reduces the vane area of the impeller to such an extent as to disable generation of the satisfactory vortexes 341, 342. Another reason is that since the entire axial length of the flow passage is changed depending on changes in the thickness of the impeller in the above experimental examples, the flow passage becomes too short in the axial direction as a whole to generate the satisfactory vortexes 341, 342.

On the other hand, when the impeller thickness t is set to a large value, the pump efficiencies drop, to a small extent. Since the entire axial length of the flow passage is changed depending on changes in the thickness of the impeller in the above experimental examples, it is believed that the flow passage becomes too long in the axial direction as a whole to generate the satisfactory vortexes 341, 342.

On the other hand, when the impeller thickness t is set to a large value, the pump efficiencies drop to a small extent. Since the entire axial length of the flow passage is changed depending on changes in the thickness of the impeller in the above experimental examples, it is believed that the flow passage becomes too long in the axial direction as a whole to generate the satisfactory vortexes 341, 342.

As described above, upon reviewing the test results of FIGS. 8 and 9 obtained from the experimental examples in Tables 2 and 3, it has been proved that by providing communicating passages in the impeller and setting the ratio of L1/L2 in the range of about 0.1 to 0.6, there can be obtained pump efficiency almost equal to or higher than conventional pumps.

It is also found from the test results of FIGS. 8 and 9 that the pump efficiency is maximized with the dimension values of Table 1 when the ratio of L/L2 is set to 0.4. In view of the above test results, the dimension values shown in Table 1 are adopted in this first embodiment.

With the first embodiment, as described above, since the partition walls 321 are more recessed radially inwardly as compared with the conventional impellers, the vortexes generated along the opposite sloped surfaces of each partition wall 321 can flow into the dead zone 96 (see FIG. 22) of the flow passage which has been formed in the conventional pumps, so that generation of the counter flow in the dead zone 96 is prevented to improve the pump efficiency.

Description will now be given of the reason why the diameter D of the impeller and the axial length k of the outer end face of the partition wall are set in the first embodiment to the values shown above in Table 1.

Figure 10:
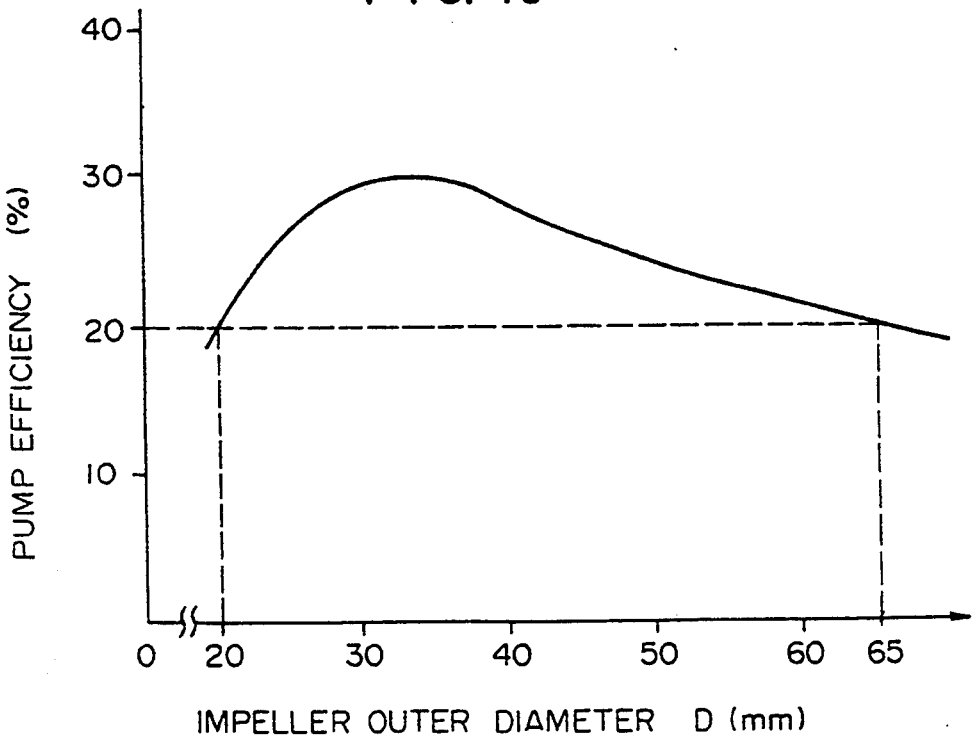
FIG. 10 is a graph showing pump efficiency of a conventional fuel pump when a dimension parameter D is changed.

FIG. 10 is a graph showing pump efficiencies resulting when the diameter D of the impeller is changed in the conventional Westco type fuel pump having no communicating groove.

A characteristic curve plotted in FIG. 10 was obtained by fabricating plural pumps by way of trial which had dimension values as shown in Table 4 below with only the diameter D of the impeller changed, and measuring their pump efficiencies.

TABLE 4

| D | t | d1 d2 | d3 | R | L1 | L2 | Rm | k |
|---|---|---|---|---|---|---|---|---|
| — | 2.4 | 0.7 | 0.7 | 4 | 0 | 2.4 | 0.7 | 0.3 |

D: diameter t: thickness d1,d2: axial gap d3: radial gap R: curvature of recessed surface L1: entire radial length of communicating passage L3: entire radial length of vane Rm: flow passage representative size k: end face length of partition wall (all dimensions in millimeters)

From FIG. 10, it is found that, despite the use of conventional pumps, efficiency at an almost satisfactory level not less than 20% can be obtained when the impeller diameter is in the range of 20 mm to 65 mm. It is also presumed that in the case of the present pumps as well which have the communicating grooves like the above first embodiment and hence the different impeller configuration, the best efficiency can be obtained with the dimension values close to those shown in Table 4, when the impeller diameter is in the range of 20 mm to 65 mm.

In the characteristic curve of FIG. 10, if the impeller diameter D is set below 20 mm, the efficiency declines to a large extent and, if the impeller diameter D is set above 65 mm, the efficiency declines gently. It is believed that the small impeller diameter makes the length of the flow passage too short to provide such passage portions as effectively functioning as a pump. It is also believed that the large impeller diameter makes a sliding resistance due to warping of the impeller so large as to lower the efficiency.

Figure 11:
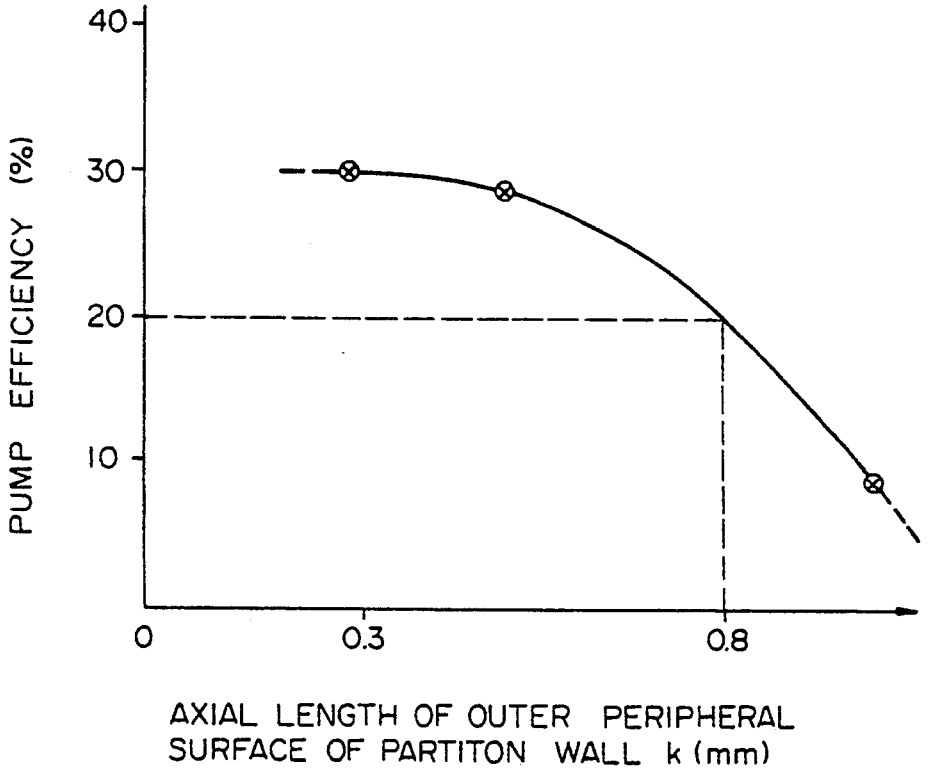
FIG. 11 is a graph showing pump efficiency of the conventional fuel pump when a dimension parameter k is changed.

FIG. 11 is a graph showing pump efficiencies resulting when the axial length k of the outer peripheral surface (radial distal end face) of the impeller partition wall is changed in the convectional Westco type fuel pump having no communicating groove.

A characteristic curve plotted in FIG. 11 was obtained by fabricating plural pumps by way of trial which had dimension values as shown in Table 5 below with only the aforesaid length k changed, and measuring their pump efficiencies.

TABLE 5

| D | t | d1 d2 | d3 | R | L1 | L2 | Rm | k |
|---|---|---|---|---|---|---|---|---|
| 30 | 2.4 | 0.7 | 0.7 | 4 | 0 | 2.4 | 0.7 | — |

D: diameter t: thickness d1,d2: axial gap d3: radial gap R: curvature of recessed surface L1: entire radial length of communicating passage L3: entire radial length of vane Rm: flow passage representative size k: end face length of partition wall (all dimensions in millimeters)

From FIG. 11, it is found that, despite the use of the conventional pumps, the efficiency at an almost satisfactory level not less than 20% can be obtained when the length k is in the range of 0.3 mm to 0.8 mm. Judging from the characteristic curve of FIG. 11, it is further presumed that the efficiency at an almost satisfactory level not less than 20% would be also obtained when the length k is in the range not larger than 0.3 mm. However, since the impeller is formed of resin materials and molded by using molds as shown in FIG. 7, setting the length k below 0.2 mm is difficult from the standpoint of strength and feasibility of the manufacture technique.

From the above test results, it is also presumed that in the case of the present pumps as well which have the communicating grooves like the above first embodiment and hence the different impeller configuration, the best efficiency can be obtained with the dimension values close to those shown in Table 5, when the length k is in the range of 0.2 mm to 0.8 mm.

In the characteristic curve of FIG. 11, if the length k is set above 0.8 mm, the efficiency declines gently. It is believed that the large length k increases the flow dead zone 96 (see FIG. 22) excessively.

From the results of the above experiments, it is believed that with the present pumps having communicating grooves like the first embodiment, high efficiency can be obtained when the ratio of L1/L2 is in the range of about 0.1 to 0.6. It is also believed that high efficiency can be obtained by setting the ratio of L1/L2 in the range of about 0.1 to 0.6 when the axial gap d1=d2 is in the range of 0.7 mm to 0.8 mm. Further, it is believed that high efficiency can be obtained by setting the ratio of L1/L2 in the range of about 0.1 to 0.6 when the impeller thickness t is in the range of 2.4 mm to 3.0 mm. In addition, it is presumed that the above operating advantage is obtained when the impeller diameter D is in the range of about 20 mm to 65 mm, and when the axial length k of the outer peripheral surface of the partition wall is in the range of about 0.2 mm to 0.8 mm.

Description will next be given of a specific advantage due to the outer peripheral surface 3210 of the partition wall. Test results will be explained, which were obtained by fabricating impellers having respective configurations shown in FIGS. 12, 13 and 14. All these experimental impellers have vane grooves which were formed by cutting outer peripheral portions of a disk plates.

Figure 12:
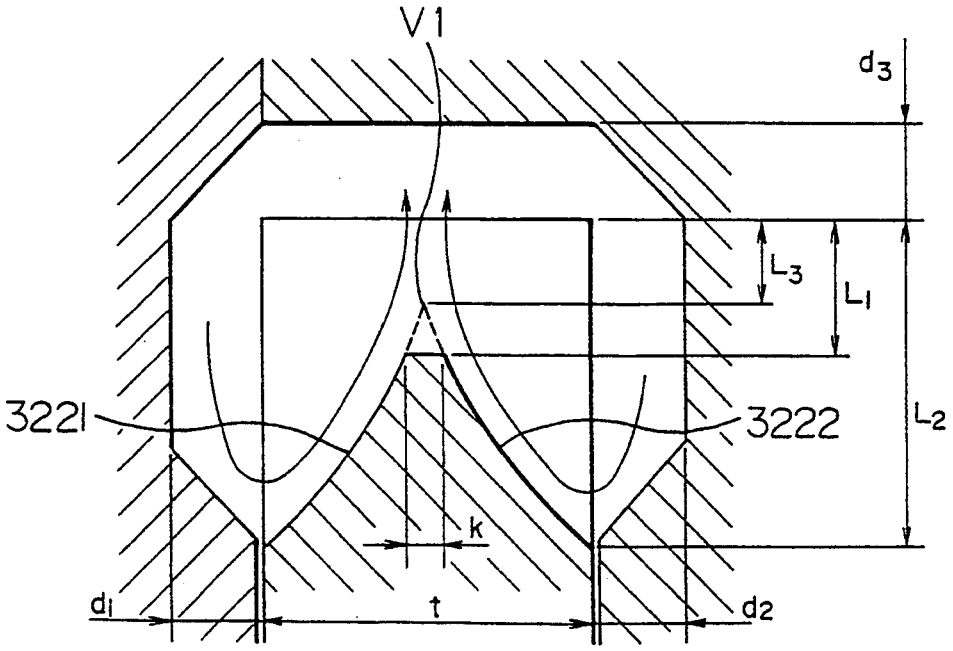
FIG. 12 is an enlarged sectional view showing principal parts of an impeller made by way of trial in accordance with this invention.

First, FIG. 12 is a sectional view of the impeller 32 and the flow passage of the test example to which the present invention is applied. The relevant dimensional values are as shown in Table 6 below.

TABLE 6

| D | t | d1, d2,d3 | R | L3 | L1 | L2 | Rm | k |
|---|---|---|---|---|---|---|---|---|
| 30 | 2.35 | 0.7 | 4 | 0.6 | 1.0 | 2.4 | 0.7 | 0.3 |

D: diameter t: thickness d1,d2: axial gap d3: radial gap R: curvature of recessed surface L1: entire radial length of communicating passage L3: entire radial length of vane Rm: flow passage representative size k: end face length of partition wall (all dimensions in millimeters)

The impeller 32 of FIG. 12 is of the same configuration as the impeller 32 described before by referring to FIG. 2 and Table 1. Note that the thickness t in Table 1 is given as 2.4 mm by rounding 2.35 mm to one decimal place.

In FIG. 12, V1 represents an imaginary cross point at which the bottom surfaces 3221, 3222 of the vane groove 322 would intersect with each other when extended with their radius of curvature. In this test example, the imaginary cross point V1 is located in the communicating passage or groove 322c nearly at the middle of the entire radial length L1 of the communicating passage.

Figure 13:
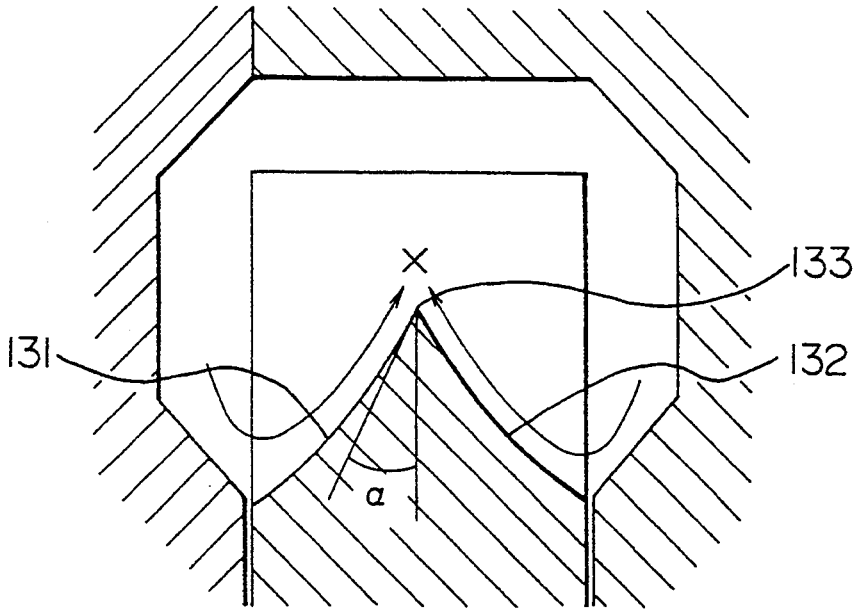
FIG. 13 is an enlarged sectional view showing principal parts of an impeller of a first comparative example made by way of trial for comparing performance with the impeller of FIG. 12.

FIG. 13 is a sectional view showing the configurations of an impeller and a flow passage of a first comparative example.

In this first comparative example, under the same dimension values as shown in Table 6, bottom surfaces 131, 132 of each vane groove are formed so as to intersect with each other inside the distal end of each vane plate by moving their centers of curvature. Accordingly, the dimension values of this example are as shown in Table 7 below. The distance to cross point L3 indicates a distance between the distal end of each vane plate and an distal end 133 of each partition wall.

TABLE 7

| D | t | d1, d2, d3 | R | L3 | L1 | L2 | Rm | k |
|---|---|---|---|---|---|---|---|---|
| 30 | 2.35 | 0.7 | 4 | 1.0 | 1.0 | 2.4 | 0.7 | 0 |

D: diameter t: thickness d1,d2: axial gap d3: radial gap R: curvature of recessed surface L1: entire radial length of communicating passage L3: entire radial length of vane Rm: flow passage representative size k: end face length of partition wall (all dimensions in millimeters)

Figure 14:
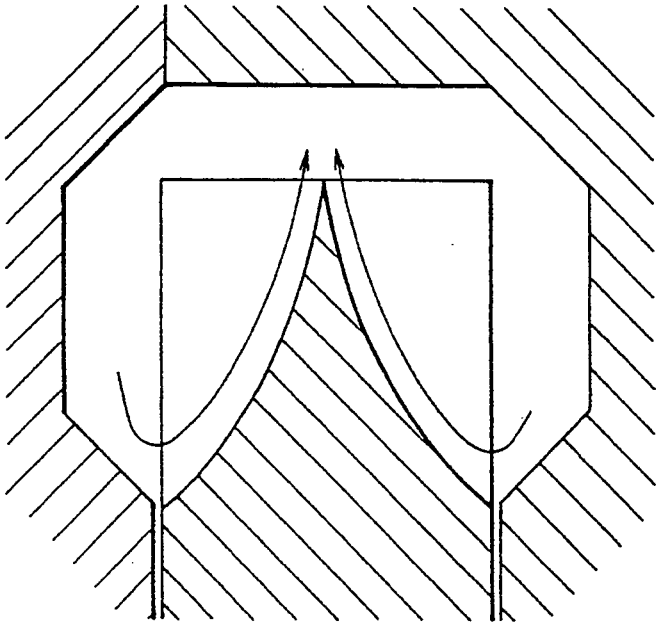
FIG. 14 is an enlarged sectional view showing principal parts of an impeller of a second comparative example.

FIG. 14 is a sectional view showing the configurations of an impeller and a flow passage of a second comparative example.

In this second comparative example, under the same dimension values as shown in Table 6, bottom surfaces of each vane groove are formed so as to intersect with each other at the distal end of each vane plate by moving their centers of curvature. Accordingly, the dimension values of this example are as shown in Table 8 below.

TABLE 8

| D | t | d1, d2,d3 | R | L3 | L1 | L2 | Rm | k |
|---|---|---|---|---|---|---|---|---|
| 30 | 2.35 | 0.7 | 4 | 0 | 0 | 2.4 | 0. 7 | 0 |

D: diameter t: thickness d1,d2: axial gap d3: radial gap R: curvature of recessed surface L1: entire radial length of communicating passage L3: entire radial length of vane Rm: flow passage representative size k: end face length of partition wall (all dimensions in millimeters)

Figure 15:
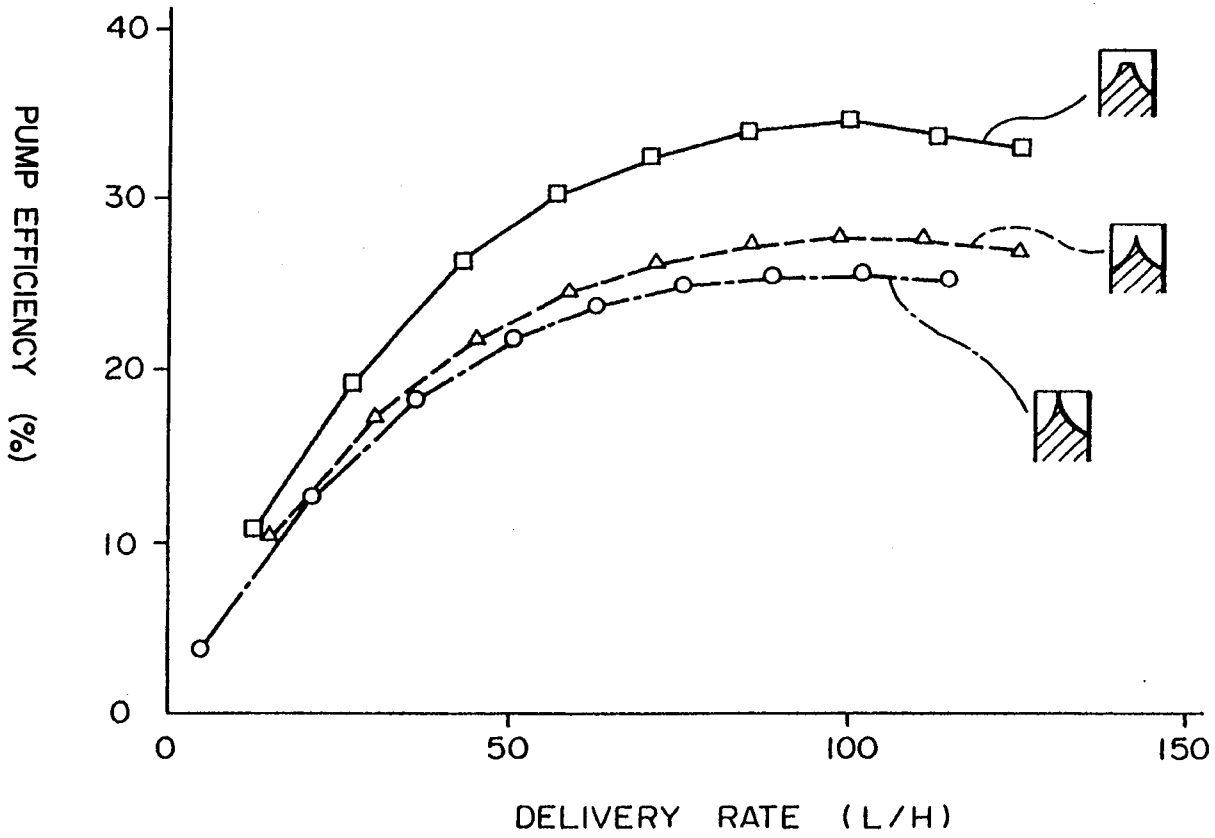
FIG. 15 is a graph showing pump efficiencies of fuel pumps using the impellers of FIGS. 12 to 14.

FIG. 15 is a graph showing pump efficiencies of the test example, the first comparative example, and the second comparative example, respectively, illustrated in FIGS. 12, 13 and 14. In FIG. 15, the solid line plotted by squares represents the test example of FIG. 12, the broken line plotted by triangles represents the first comparative example of FIG. 13, and the one-dot-chain line plotted by circles represents the second comparative example of FIG. 14.

As will be seen from the graph of FIG. 15, the impeller having the configuration of FIG. 12 has been proven to have the maximum efficiency. It is believed that the resulting difference in efficiency is attributable to the difference in vortex currents of fuel caused by the rotation of the impeller.

In the case of FIG. 12, the vortex fuel flows generated around each vane groove first flow along the bottom surfaces 3221, 3222 of the vane groove and then merge together near the center of the communicating passage to flow outwardly in the radial direction. In this test example, the (outer peripheral) distal end surface 3210 of each partition wall of the impeller is formed into a flat surface with a predetermined thickness of length k. With this configuration, there is formed outside the distal end surface 3210 of the partition wall an area into which the vortex fuel currents coming along the bottom surfaces 3221, 3222 will not directly enter, and the fuel stagnates in that area. It is considered that the higher pump efficiency as shown in FIG. 15 results because the fuel stagnating outside the distal end surface 3210 of the partition wall acts to allow the vortex fuel currents coming along the bottom surfaces 3221, 3222 to smoothly merge together.

Meanwhile, in the case of the first comparative example of FIG. 13, the vortex fuel currents coming along the bottom surfaces 3221, 3222 abruptly strike against each other just outside the pointed distal end 133 of the partition wall, and then flow outwardly in the radial direction. With the configuration as shown in FIG. 13, however, when the fuel flows along the bottom surfaces 3221, 3222 strike against each other, both the fuel currents have large axial components. It is believed that such axial components make both the fuel currents dampen mutually and hence are weaker, as to reduce the pump efficiency as composed to the configuration of FIG. 12.

For moderating the above mutual collision of the fuel currents, it could be contemplated to make smaller an angle $\alpha$ indicated in FIG. 13. However, when the impeller is molded using resin materials, there is a difficulty in realizing the desired small angle $\alpha$ from the standpoint of strength and feasibility of the manufacture technique.

For the case of the second comparative example of FIG. 14, it is believed that the mutual collision of the fuel currents are moderated in comparison with the example of FIG. 13, but the vertically long partition wall makes so small the volume of the vane groove as to reduce the pump efficiency.

In sum, it is believed that with the impeller of FIG. 12, the mutual collision of the two vortex fuel flows are prevented by the fuel stagnating outside the distal end of the partition wall, that the stagnating fuel functions as an imaginary partition wall which allows the two vortex fuel flows to smoothly merge together. As a result, the strong vortex fuel flows are produced over the region from the vane grooves of the impeller to the flow passage, thereby providing a high level of pump efficiency.

Figure 16:
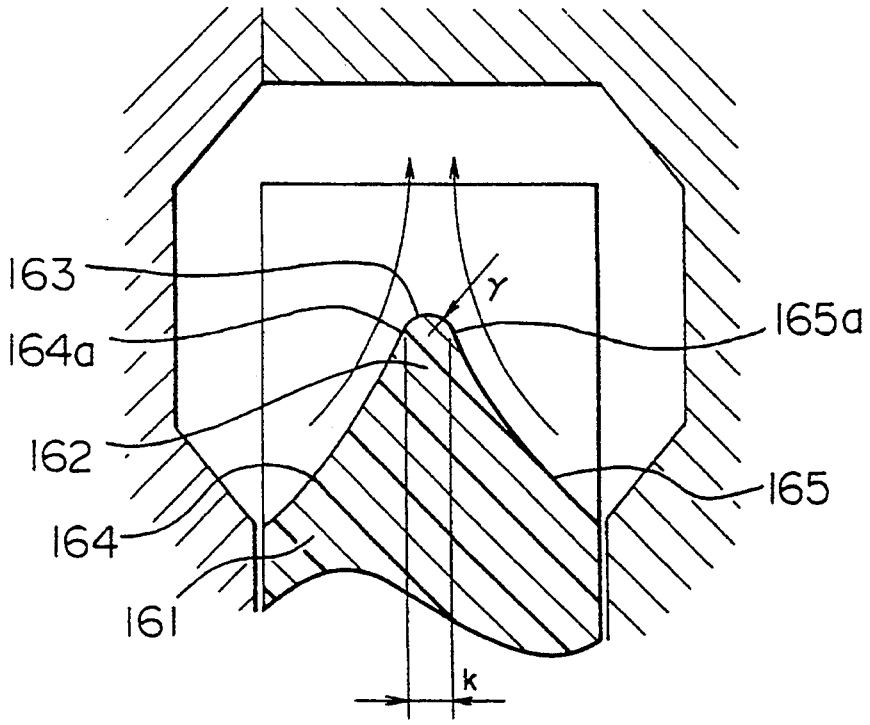
FIG. 16 is an enlarged sectional view showing principal parts of an impeller of a fuel pump according to a second embodiment of the invention.

FIG. 16 shows a sectional view of an impeller of a fuel pump according to a second embodiment of the invention.

In the impeller of this second embodiment, as with the first embodiment, bottom surfaces of each vane groove are formed with the radius of curvature corresponding to the vortex fuel currents generated by the rotation of the impeller. A predetermined thickness k is provided between outermost peripheral ends of the bottom surfaces. Each bottom surface has a radius of curvature corresponding to the vortex fuel currents. In this second embodiment, a curved surface 163 is formed at a distal end of each partition wall 162 of the impeller 161. The partition wall 162 of this second embodiment has the thickness k of about 0.3 mm between outermost peripheral ends 164*a*, 165*a* of bottom surfaces 164, 165 having the radius of curvature R. In other words, in this second embodiment, the thickness k of the partition wall 162 is set to about 0.3 mm at flexion points of curved lines which define an outer configuration of the partition wall 162. Dimension values of other pump components are the same as those in the first embodiment. Also in this embodiment, there is formed outside the curved surface at the distal end of the partition wall an area into which the vortex fuel currents coming along the bottom surfaces 164, 165 will not directly enter. Then, the fuel stagnating in that area acts to allow the two vortex fuel currents to smoothly merge together.

Figure 17:
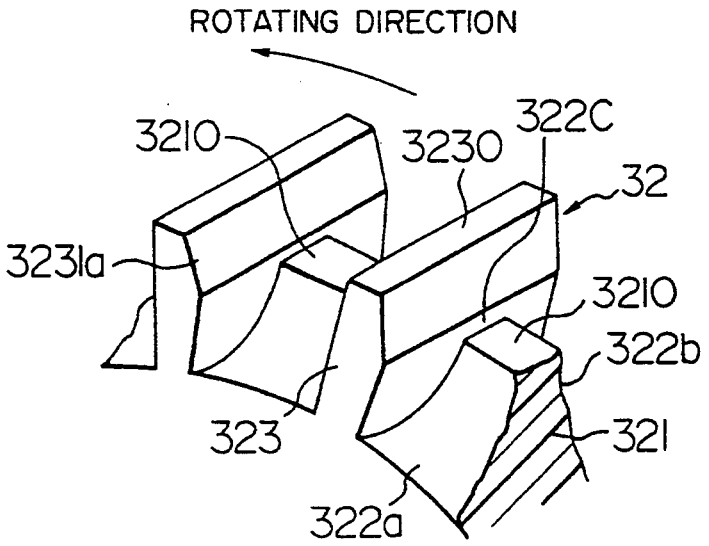
FIG. 17 is a fragmentary perspective view showing an impeller of a fuel pump according to a third embodiment of the invention.

FIG. 17 shows a perspective view of an impeller of a fuel pump according to a third embodiment of the invention.

In the impeller of this third embodiment, an upper rear edge of each vane plate 323, i.e., an upper end corner of each vane plate 323 on its trailing side with respect to the rotating direction of an impeller 32, is chamfered to form a sloped surface 3231*a*. The fuel flowing out of one vane groove 322 of the impeller 32 in the form of the aforesaid vortexes 342, 342 is introduced, after vortex in the flow passage, into another succeeding vane groove 322 again to be given further vortex forces. At this time, with the impeller of this third embodiment, the vortexes 341, 342 flowing out of the one vane groove 322 are more easily introduced to the succeeding vane groove 322. Accordingly, loss of the vortex fuel currents generated by the impeller 32 is reduced to raise the pump efficiency.

Figure 18:
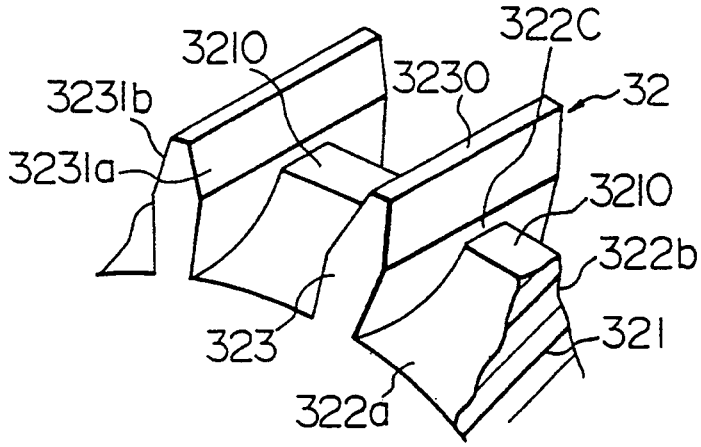
FIG. 18 is a fragmentary perspective view showing an impeller of a fuel pump according to a fourth embodiment of the invention.

FIG. 18 shows a respective view of an impeller of a fuel pump according to a fourth embodiment of the invention.

In the impeller of this fourth embodiment, in addition to the sloped surface 3231*a* in FIG. 17, an upper front edge of each vane plate 323 is also chamfered to form a sloped surface 3231*b*. Accordingly, loss of the vortex fuel currents is reduced as with the above third embodiment. Moreover, this fourth embodiment has another advantage that the impeller 32 can be assembled without taking into account the rotating direction.

Figure 19:
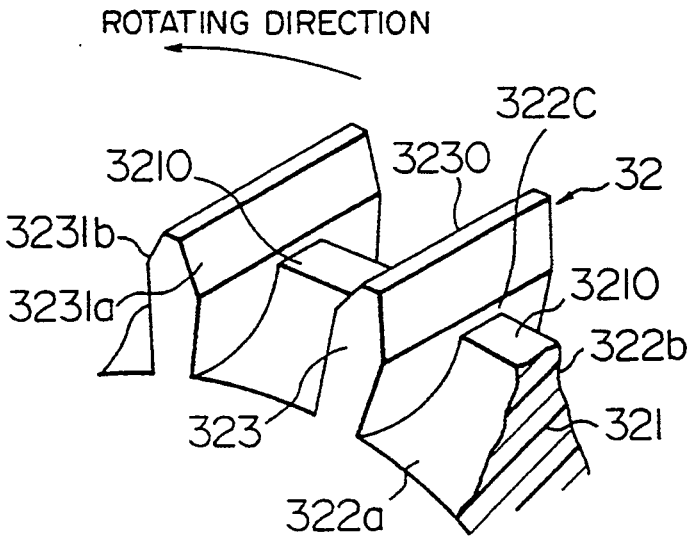
FIG. 19 is a fragmentary perspective view showing an impeller of a fuel pump according to a fifth embodiment of the invention.

FIG. 19 shows a perspective view of an impeller of a fuel pump according to a fifth embodiment of the invention.

An impeller 32 of this fifth embodiment is different from that of the above fourth embodiment shown in FIG. 18 in that the front sloped surfaces 3231*b* is chamfered to a smaller extent and the rear sloped surface 3231*a* is chamfered to a larger extent, thus making both the sloped surfaces asymmetrical in their shapes. This fifth embodiment can also reduce loss of the vortex fuel currents similarly to the above embodiments.

Figure 20:
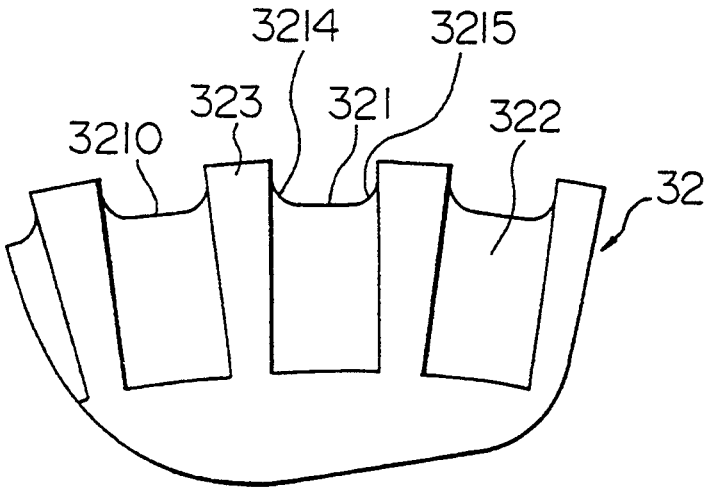
FIG. 20 is a fragmentary plan view showing an impeller of a fuel pump according to a six embodiment of the invention.
Figure 21:
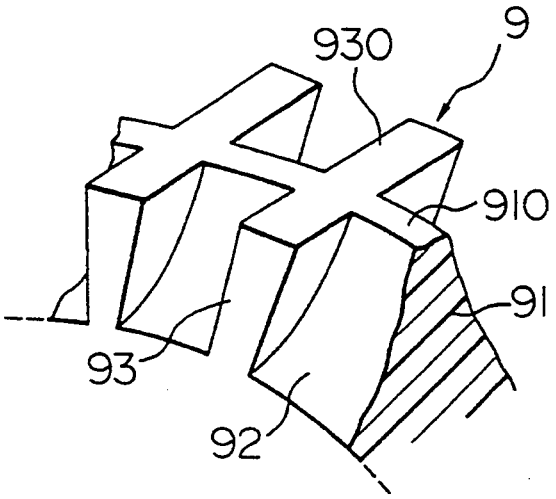
FIG. 21 (PRIOR ART)
FIG. 21 is a fragmentary perspective view a conventional impeller.

FIG. 20 shows a plan view of an impeller of a fuel pump according to a sixth embodiment of the invention.

In this sixth embodiment, an impeller 32 is formed such that each partition wall 321 is joined to two adjacent vane plates 323 through smooth curved portions 3214, 3215 at both circumferential ends of an outer peripheral surface 3210 of the partition wall 321. With this embodiment, a circumferential fuel current following the outer peripheral surface 3210 of the partition wall 321 flows along the curved portions 3214, 3215 ill joint areas with the vane plates 323. Therefore, the fuel current is not impeded and its loss can be reduced. Additionally, at the time when grinding the outer periphery of the impeller, a large stress is exerted on the vane plate 323. By providing the curved portions in the joint areas with the vane plates 323 like this sixth embodiment, the vane plates 323 can be so reinforced as to prevent possible damage or deformation of the vane plates 323.

It should be noted that in the Figures referred to for description of the foregoing embodiments, the configuration of the impeller in each embodiment is exaggerated and, in particular, the distal end face of the partition wall of the impeller is illustrated to be larger than the actual dimensions.

Further, the impeller of each fuel pump is supported to rotate at a rotational speed of 3000 to 15000 rpm as usual. Thus, in the foregoing embodiments, desired pump performance is obtained in such a range of the rotational speed.

Although the invention has been described in conjunction with the embodiments, it should be understood that the invention can be practiced in various forms other than the illustrated specific forms without departing from the scope of attached claims.

What is claimed is:

1. A fuel pump for an automotive fuel supply system comprising:

a disk-like impeller having vane grooves, vane plates, and partition walls, said vane grooves and said vane plates being formed alternately along an outer periphery of said impeller, said impeller having a diameter between about 20 mm and about 65 mm, each of said vane grooves including a first groove portion on one lateral side of said impeller, a second groove portion on another lateral side of said impeller, and a communicating groove positioned radially outside said first and second groove portions for allowing said first and second groove portions to communicate with each other in an axial direction, each of said partition walls being positioned between said first and second groove portions to provide bottom surfaces of said first and second groove portions, said bottom surfaces being formed so as to gradually approach each other in a radially outward direction of said impeller, said vane plates extending outwardly in a radial direction of said impeller farther than a radially outwardly termination of said bottom surfaces, wherein at said termination of said bottom surfaces, said bottom surfaces are separated from each other at a blunt radially distal edge of said impeller by a predetermined distance of about 0.2 mm to about 0.8 mm therebetween to define said communicating groove;

a casing rotatably accommodating said impeller, defining a pump flow passage for fuel along said vane plates and having an intake port to take in unpressurized fuel and a delivery port for outputting pressurized fuel at a delivery rate between about 5 l/h to about 200 l/h, both said intake port and said delivery port communicating with said pump flow passage, wherein a pump flow passage representative size is defined by said impeller and said flow passage and is between about 0.4 mm to about 2.0 mm; and a motor for rotating said impeller to pressurize said fuel to a pressure between 2 to 5 kfg/cm$^2$, wherein a ratio L1/L2 of a distance L1 between a distal end of each said vane plate and said distal edge of each said partition wall to an entire length L2 of each said vane plate is in the range of 0.1 to 0.6.

2. A fuel pump according to claim 1, wherein each of said partition walls has a distal end face for joining said bottom surface of said first groove portion and said bottom surface of said second groove portion to each other.

3. A fuel pump according to claim 2, wherein said distal end face is a flat surface.

4. A fuel pump according to claim 2, wherein said distal end face is a curved surface.

5. A fuel pump according to claim 2, wherein joint portions between each said partition wall and adjacent vane plates are formed smoothly.

6. A fuel pump according to claim 2, wherein said bottom surfaces are each formed as a curved surface having a predetermined radius of curvature.

7. A fuel pump according to claim 6, wherein each said bottom surfaces is connected with said distal end face at a flextion point.

8. A fuel pump according to claim 2, wherein each said distal end face of said partition wall has a non-pointed surface.

9. A fuel pump according to claim 1, wherein said impeller is made of a resin.

10. A fuel pump according to claim 9, wherein said impeller is formed by molding such that the distal end face of each said partition wall, as well as said bottom surfaces of said first and second groove portions and side surfaces of said first and second groove portions and said communicating groove remain as they are after the molding, whereas said outer peripheral surface and axial lateral surfaces of each of said vane plates are ground after the molding.

11. A fuel pump according to claim 9, wherein said fuel pump is installed in a fuel tank to supply fuel to a fuel injection system of an internal combustion engine and said diameter of said impeller is about 30 mm, and an impeller thickness is between about 2.4 mm and about 3.0 mm.

12. A fuel pump according to claim 11, wherein said ratio L1/L2 is about 0.4.

13. A fuel pump according to claim 12, wherein said predetermined distance between said bottom surfaces of said impeller is about 0.3 mm.

14. A fuel pump according to claim 9, wherein said one lateral side, said another lateral side and said an outer peripheral surface of said impeller is formed by grinding, and said partition walls is formed by molding.

15. A fuel pump according to claim 1, wherein each of said vane plates has a surface sloped in a rotating direction of said impeller.

16. A fuel pump according to claim 1, wherein each of said first groove portions and each of said second groove portions extend to an outer peripheral surface of said impeller.

17. A fuel pump according to claim 1, wherein said first and second groove portions and said communicating groove are defined between side walls of adjacent pairs of said vane plates.

18. A fuel pump according to claim 1, wherein said impeller is a molded impeller, and wherein an outer peripheral surface of said molded impeller is formed by grinding.

19. A fuel pump comprising:

a disk-like impeller made from a resinous material and having vane plates and partition walls provided alternately along an outer periphery of said impeller, said vane plates being each formed to face in a circumferential direction of said impeller, said partition walls being each formed to project outwardly between adjacent pairs of said vane plates in a radial direction of said impeller and each having two sloped surfaces respectively facing in an axial direction of said impeller, said two sloped surfaces being formed such that imaginary radial extensions of said two sloped surfaces intersect with each other at a point (V1) positioned inside a circumferentially facing surface of each of said vane plates with respect to said radial direction of said impeller, said sloped surfaces terminating at their respective outermost peripheries with a distance of between about 0.2 mm and about 0.8 mm left therebetween, each of said partition walls having a blunt distal edge which is positioned inside an outer peripheral end of each of said vane plates and joins said two sloped surfaces to each other;

a casing rotatably accommodating said impeller, defining a pump flow passage for fuel along said vane plates and having an intake port to take in unpressurized fuel and a delivery port for outputting pressurized fuel, both said intake port and said delivery port communicating with said pump flow passage; and a motor rotating said impeller to pressurize said fuel.

20. A fuel pump according to claim 19, said distal end face is a flat surface.

21. A fuel pump according to claim 19, wherein said distal end face is a curved surface.

22. A fuel pump according to claim 19, wherein said fuel pump is installed in a fuel tank to supply fuel to a fuel injection system of an internal combustion engine and is used with a delivery pressure in the range of 2 to 5 kgf/cm$^2$ and a delivery rate in the range of 5 to 200 l/h, a diameter (D) of said impeller is in the range of 20 to 65 mm, and a flow passage representative size (Rm) defined by said impeller and said flow passage is in the range of 0.4 to 2.0 mm.

23. A fuel pump according to claim 22, wherein a ratio L1/L2 of a distance L1 between said outer peripheral end of each said vane plate and said distal end of each said partition wall to an entire length L2 of each said vane plate is in the range of 0.1 to b 0.6.

24. A fuel pump according to claim 22, wherein said two sloped surfaces terminate at their outermost peripheries to define an axial thickness of the distal edge of the impeller partition wall of about 0.3 mm, said impeller thickness being between about 2.4 mm and about 3.0 mm.

25. A fuel pump according to claim 19, wherein said impeller is formed by molding such that the distal end face and the sloped surfaces of each said partition wall and the circumferentially facing surfaces of each said vane plate remain as they are after the molding, whereas said outer peripheral surface and axial lateral surfaces of each said vane plate are ground after the molding.

26. A fuel pump according to claim 19, wherein a surface of each said vane plate facing circumferentially is sloped in a rotating direction of said impeller.

27. A fuel pump according to claim 19, wherein said distal end face of each said partition wall has portions protruding toward said distal end of each said vane plate at joints between said distal end face of each said partition wall and adjacent said vane plates.

28. A fuel pump for an automotive fuel supply system comprising:

a disk-like impeller made from a resinous material and having vane grooves, vane plates and partition walls, said vane grooves and said vane plates being formed alternately along an outer periphery of said impeller, each of said vane grooves including a first groove portion on one lateral side of said impeller, a second groove portion on another lateral side of said impeller, and a communicating groove positioned radially outside said first and second groove portions for allowing said first and second groove portions to communicate with each other in an axial direction of the impeller, each of said partition walls having a substantially blunt distal edge at a radially outermost portion thereof and being positioned between said first and second groove portions to define bottom surfaces of said first and second groove portions, said bottom surfaces being formed so as to gradually approach each other with respect to a radially outward direction of said impeller, said vane plates extending outwardly in a radial direction of said impeller farther than a radial termination of said bottom surfaces, wherein at said termination of said bottom surfaces, said bottom surfaces are separated from each other by a thickness (k) of said blunt distal edge which is between about 0.2 mm to about 0.8 mm to define said communicating groove, and wherein a ratio L1/L2 of a distance L1 between said outer peripheral end of each said vane plate and said blunt distal edge to a length L2 of each said vane plate is between about 0.1 and about 0.6;

a casing rotatably accommodating said impeller, defining a pump flow passage for fuel along said vane plates and having an intake port to take in unpressurized fuel and a delivery port for outputting pressurized fuel, both said intake port and said delivery port communicating with said pump flow passage; and a motor rotating said impeller to pressurize said fuel.

29. A fuel pump according to claim 28, further including a gap (d1) between opposing side surfaces of said flow passage and said impeller which is between about 0.6 mm and about 0.9 mm.

30. A fuel pump according to claim 29, wherein a diameter of said impeller is between about 20 mm and about 65 mm and a thickness of said impeller is between about 0.2 mm and about 0.8 mm.

31. A fuel pump according to claim 30, wherein said blunt distal edge is a flat surface with a thickness of about 0.3 mm.

32. A fuel pump according to claim 30, wherein said blunt distal end is a curved surface with a thickness of about 0.3 mm.

33. A fuel pump according to claim 30, wherein joint portions between each said partition wall and adjacent vane plates are smoothly formed to have a thickness about 0.3 mm.

34. A fuel pump according to claim 29, wherein said fuel pump is installed in a fuel tank to supply fuel to a fuel injection system of an internal combustion engine and is used with a fuel delivery pressure in the range of about 2 to about 5 kgf/cm and a fuel delivery rate in the range of about 5 to about 200 l/h, a diameter (D) of said impeller is in the range of 20 to 65 mm, and a flow passage representative size (Rm) defined by said impeller and said flow passage is between about 0.4 mm to about 2.0 mm.

35. A fuel pump according to claim 34, wherein said ratio L1/L2 is about 0.4, and wherein said gap (d1) is between about 0.7 to about 0.8.

36. A fuel pump according to claim 35, wherein said thickness (k) is about 0.3 mm, said impeller thickness (t) is between about 2.4 mm and about 3.0 mm, and said impeller diameter (D) is about 30 mm.

* * * * *